US009284826B2

(12) United States Patent
Campbell et al.

(10) Patent No.: US 9,284,826 B2
(45) Date of Patent: Mar. 15, 2016

(54) OIL EXTRACTION USING RADIO FREQUENCY HEATING

(71) Applicants: Michael John Campbell, Bakersfield, CA (US); Kathleen Judith Miller, Bakersfield, CA (US); Gunther Hans Dieckmann, Walnut Creek, CA (US); James Thomas Dunlavey, Bakersfield, CA (US); Cesar Ovalles, Walnut Creek, CA (US); Donald Leroy Kuehne, Hercules, CA (US)

(72) Inventors: Michael John Campbell, Bakersfield, CA (US); Kathleen Judith Miller, Bakersfield, CA (US); Gunther Hans Dieckmann, Walnut Creek, CA (US); James Thomas Dunlavey, Bakersfield, CA (US); Cesar Ovalles, Walnut Creek, CA (US); Donald Leroy Kuehne, Hercules, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 385 days.

(21) Appl. No.: 13/837,120

(22) Filed: Mar. 15, 2013

(65) Prior Publication Data

US 2014/0262225 A1 Sep. 18, 2014

(51) Int. Cl.
*E21B 43/24* (2006.01)

(52) U.S. Cl.
CPC ..... *E21B 43/2408* (2013.01); *E21B 43/2401* (2013.01)

(58) Field of Classification Search
USPC ..... 166/248, 57
See application file for complete search history.

(56) References Cited

U.S. PATENT DOCUMENTS

| | | | | |
|---|---|---|---|---|
| 3,170,519 | A | 2/1965 | Haagensen | |
| 4,140,180 | A | 2/1979 | Bridges et al. | |
| 4,485,868 | A | 12/1984 | Sresty et al. | |
| 4,485,869 | A | 12/1984 | Sresty et al. | |
| 4,508,168 | A | 4/1985 | Heeren | |
| 4,583,589 | A | 4/1986 | Kasevich | |
| 4,620,593 | A | 11/1986 | Haagensen | |
| 4,817,711 | A | 4/1989 | Jeamby | |
| 4,912,971 | A | 4/1990 | Jeamby | |
| 5,109,927 | A * | 5/1992 | Supernaw et al. | 166/248 |
| 5,632,336 | A | 5/1997 | Notz et al. | |
| 7,588,085 | B2 | 9/2009 | Acock et al. | |

(Continued)

OTHER PUBLICATIONS

Alvarado, V., et al.; "Enhanced Oil Recovery. Field Planning and Development Strategies", Elsevier, 2010, Chapter 1 (pp. 1-5) and Chapter 5 (pp. 81-85).

(Continued)

*Primary Examiner* — Taras P Bemko

(57) ABSTRACT

Provided herein are embodiments for extracting oil from an oil-bearing formation. An embodiment of a method includes heating a first portion of the formation with radio frequency energy generated by a radio frequency generator electrically coupled to an antenna. The antenna is positioned within a wellbore and located within the first portion to heat the first portion to a minimum temperature of about 160° F. The radio frequency generator delivers power in a range from about 50 kilowatts to about 2 Megawatts, and a power per unit length of antenna is in a range from about 0.5 kW/m to 5 kW/m. The method includes extracting the oil from the first portion after heating to create void space for steam injection. The method also includes injecting steam into the first portion to heat a second portion of the formation adjacent to the first portion and extracting the oil from the second portion.

20 Claims, 11 Drawing Sheets

(56) References Cited

U.S. PATENT DOCUMENTS

| | | | | |
|---|---|---|---|---|
| 7,730,947 | B2 | 6/2010 | Stegemeier et al. | |
| 7,891,421 | B2 | 2/2011 | Kasevich | |
| 8,191,630 | B2 | 6/2012 | Stegemeier et al. | |
| 8,464,789 | B2 | 6/2013 | Banerjee et al. | |
| 8,534,350 | B2 | 9/2013 | Sultenfuss et al. | |
| 8,720,547 | B2 | 5/2014 | Banerjee et al. | |
| 8,720,549 | B2 | 5/2014 | Banerjee et al. | |
| 8,936,090 | B2 | 1/2015 | Sultenfuss et al. | |
| 9,027,638 | B2 | 5/2015 | Madison et al. | |
| 2010/0219108 | A1* | 9/2010 | Parsche | 208/402 |
| 2010/0270015 | A1* | 10/2010 | Vinegar et al. | 166/272.1 |
| 2011/0079402 | A1* | 4/2011 | Darby et al. | 166/385 |
| 2011/0253367 | A1 | 10/2011 | Banerjee et al. | |
| 2011/0253368 | A1 | 10/2011 | Banerjee et al. | |
| 2011/0253370 | A1 | 10/2011 | Banerjee et al. | |
| 2011/0309988 | A1* | 12/2011 | Parsche | 343/793 |
| 2012/0018140 | A1* | 1/2012 | Parsche | 166/60 |
| 2012/0061080 | A1 | 3/2012 | Sultenfuss et al. | |
| 2012/0061081 | A1 | 3/2012 | Sultenfuss et al. | |
| 2012/0085533 | A1 | 4/2012 | Madison et al. | |
| 2014/0266951 | A1 | 9/2014 | Okoniewski et al. | |

OTHER PUBLICATIONS

Boberg, T. C.; "Thermal Methods of Oil Recovery", John Wiley & Sons, 1988, Chapter 8, pp. 132-144.

Kasevich, R.S., et al.; "Numerical Modeling of Radio Frequency Heating Process for Enhanced Oil Production"; SPE 38311, Jun. 1997, pp. 501-505.

Kasevich, R.S., et al.; "Pilot Testing of a Radio Frequency Heating System for Enhanced Oil Recovery From Diatomaceous Earth"; SPE 28619, Sep. 1994, pp. 105-118, and also a "corrections and clarifications" page.

* cited by examiner

OIL EXTRACTION USING RADIO FREQUENCY HEATING

BACKGROUND

One technique for extracting oil from an oil bearing formation involves the drilling of a well into the formation and pumping the oil out. In many cases, however, the oil is too viscous under the formation conditions, and thus adequate oil flow rates cannot be achieved with this technique.

Enhanced oil recovery techniques have been developed to improve the oil flow rate. One example of an enhanced oil recovery technique involves the injection of steam into the oil bearing formation. The steam increases the temperature of the oil and reduces the oil's viscosity. The oil can then be pumped from the oil bearing formation with an improved oil flow rate. However, some formations are not receptive to steam injection. For example, in some reservoirs, the injected steam will not evenly penetrate the oil bearing formation, but may instead channel along the well casing or travel along more easily fractured strata or higher permeability zone or zones. As a result, only a small portion of the oil bearing formation is heated with steam.

SUMMARY

In general terms, this disclosure is directed to oil extraction using radio frequency heating. Various aspects are described in this disclosure, which include, but are not limited to, the following aspects.

One aspect is a method of extracting oil from an oil-bearing formation, the method comprising: heating a first portion of the formation containing oil with radio frequency energy; extracting the oil from the first portion of the formation; injecting steam into the first portion of the formation to heat a second portion of the formation containing oil adjacent the first portion; and extracting the oil from the second portion of the formation.

Another aspect is an oil extraction system comprising: a radio frequency generator; an antenna configured to be inserted into a wellbore and coupled to the radio frequency generator to generate radio frequency energy and to heat a first portion of a formation containing oil adjacent the wellbore; a pump configured to pump oil from the first portion of the well; and a steam generator configured to supply steam into the first portion of the formation after the oil from the portion of the formation has been removed.

DETAILED DESCRIPTION

Figure 1:
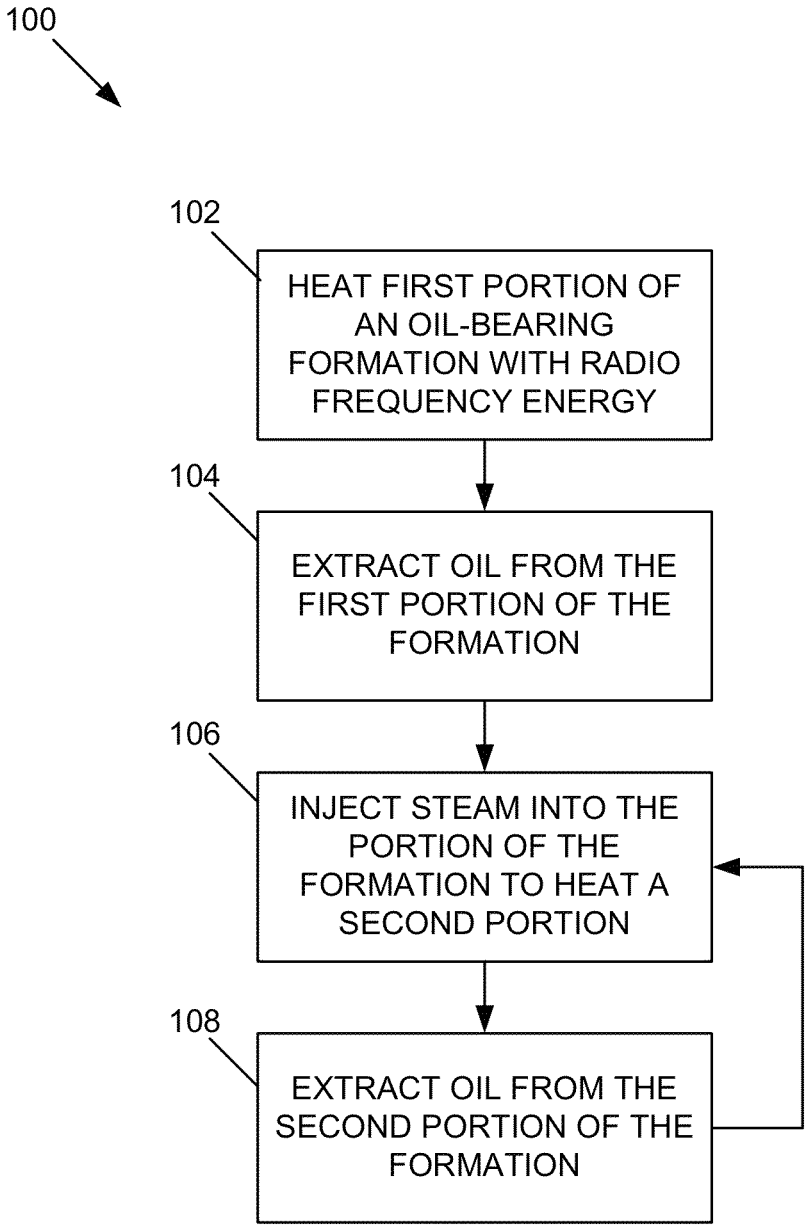
FIG. 1 is a flow chart illustrating an example method of extracting oil from an oil-bearing formation.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a flow chart illustrating an example method 100 of extracting oil from an oil-bearing formation. In this example, the method includes operations 102, 104, 106, and 108.

The operation 102 is performed to heat a first portion of an oil-bearing formation using radio frequency energy. An example of the operation 102 is illustrated and described in more detail with reference to FIG. 3.

The operation 104 is performed to extract the oil from the first portion of the formation. An example of the operation 104 is illustrated and described in more detail with reference to FIG. 7.

The operation 106 is performed to inject steam into the portion of the formation to heat a second portion of the formation containing oil adjacent the first portion. An example of the operation 106 is illustrated and described in more detail with reference to FIGS. 8-9.

The operation 108 is performed to extract the oil from the second portion of the formation. An example of the operation 108 is illustrated and described in more detail with reference to FIGS. 10-11.

In some embodiments the operations 106 and 108 are repeated for additional (i.e., third, fourth, fifth, etc. portions of the formation). In some embodiments, operations 106 and 108 are performed simultaneously, such as by utilizing continuous steam injection (operation 106) and simultaneous oil extraction (operation 108).

Some embodiments further include one or more soaking operations following either the RF heating operation 102 or the steam injection operation 106. The soaking operation involves waiting for a period of time to allow the heat to spread through the respective portion of the formation to warm the portion and to allow the oil within that portion to flow to a location where it can be extracted.

In some embodiments, the operations 102, 104, 106, and 108 are performed in the order shown in FIG. 1. In other embodiments, the operations are performed in a different order than illustrated herein, or with additional or different operations. For example, in some embodiments the operations 102 and 104, and/or the operations 106 and 108, are performed simultaneously. As another example, one or more alternative heating operations or extraction operations are performed in other embodiments. As yet another example, one or more additional fluids can be added to further improve the extraction of the oil from the formation. Additional examples are discussed herein.

Figure 2:
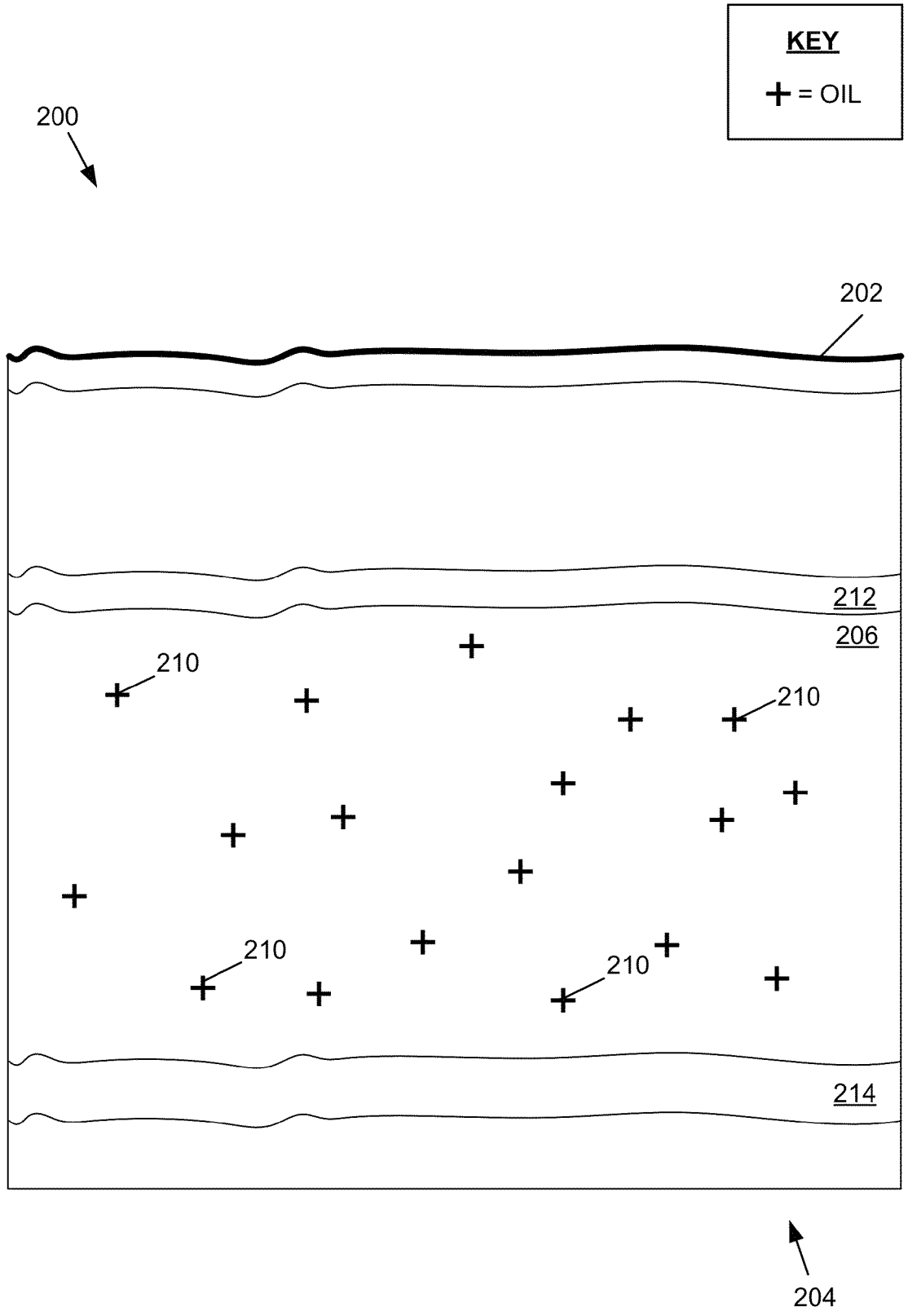
FIG. 2 is a cross-sectional view of a portion of the Earth including an oil-bearing formation.

FIG. 2 is a schematic cross-sectional view of a portion 200 of the Earth. In this example, the portion 200 of the Earth includes a surface 202, a plurality of underground layers 204, and an oil-bearing formation 206. The oil-bearing formation 206 includes oil 210.

Typically the oil-bearing formation is trapped between layers 204 referred to as overburden 212 and underburden 214. These layers are often formed of a fluid impervious material that has trapped the oil 210 in the oil-bearing formation 206. As one example, the overburden 212 and underburden 214 may be formed of a tight shale material.

In this example, the portion 200 of the earth includes the oil-bearing formation 206, which includes oil 210. In addition to the oil 210, the oil-bearing formation typically also includes additional materials. The materials can include solid, liquid, and gaseous materials. Examples of the solid materials are quartz, feldspar, and clay. Examples of the liquid materials include water and brine. Examples of gaseous materials include methane, ethane, propane, butane, carbon dioxide, and hydrogen sulfide.

The oil 210 is a liquid substance to be extracted from the portion 200 of the Earth. In some embodiments, the oil 210 is heavy oil. Heavy oil naturally occurs when oxygen is present in the formation, such as from an underground water supply, which allows bacteria to biodegrade the oil 210 turning the oil from light or medium oil into heavy or extra heavy oil.

One measure of the heaviness or lightness of a petroleum liquid is American Petroleum Institute (API) gravity. According to this scale, light crude oil is defined as having an API gravity greater than 31.1° API (less than 870 kg/m3), medium oil is defined as having an API gravity between 22.3° API and 31.1° API (870 to 920 kg/m3), heavy crude oil is defined as having an API gravity between 10.0° API and 22.3° API (920 to 1000 kg/m3), and extra heavy oil is defined with API gravity below 10.0° API (greater than 1000 kg/m3).

Because the oil 210 is intermixed with other materials within the oil-bearing formation, and also due to the high viscosity of the oil, it can be difficult to extract the oil from the oil-bearing formation. For example, if a well is drilled into the oil-bearing formation 206, and pumping is attempted, very little oil is likely to be extracted. The viscosity of the oil 210 causes the oil to flow very slowly, resulting in minimal oil extraction.

An enhanced oil recovery technique could also be attempted. For example, an attempt could be made to inject steam into the formation. However, it has been found that some formations are not receptive to steam injection. The ability of a formation to receive steam is sometimes referred to as steam injectivity. When the formation has poor steam injectivity, little to no steam can be evenly pushed into the formation. The steam may have a tendency to channel along the wellbore, for example, rather than penetrating into the formation 206. Alternatively, the steam may also travel along easily fractured strata or regions of high permeability, thus leading to poor steam injectivity. Accordingly, there is a need for another technique for at least initiating the extraction of oil from the oil-bearing formation that does not rely on the initial injection of steam into the formation when the formation has poor steam injectivity.

In some embodiments the oil extraction techniques disclosed herein extract the oil without creating fractures in the mineral formation to increase steam injectivity, or at least without attempting to create such fractures.

Figure 3:
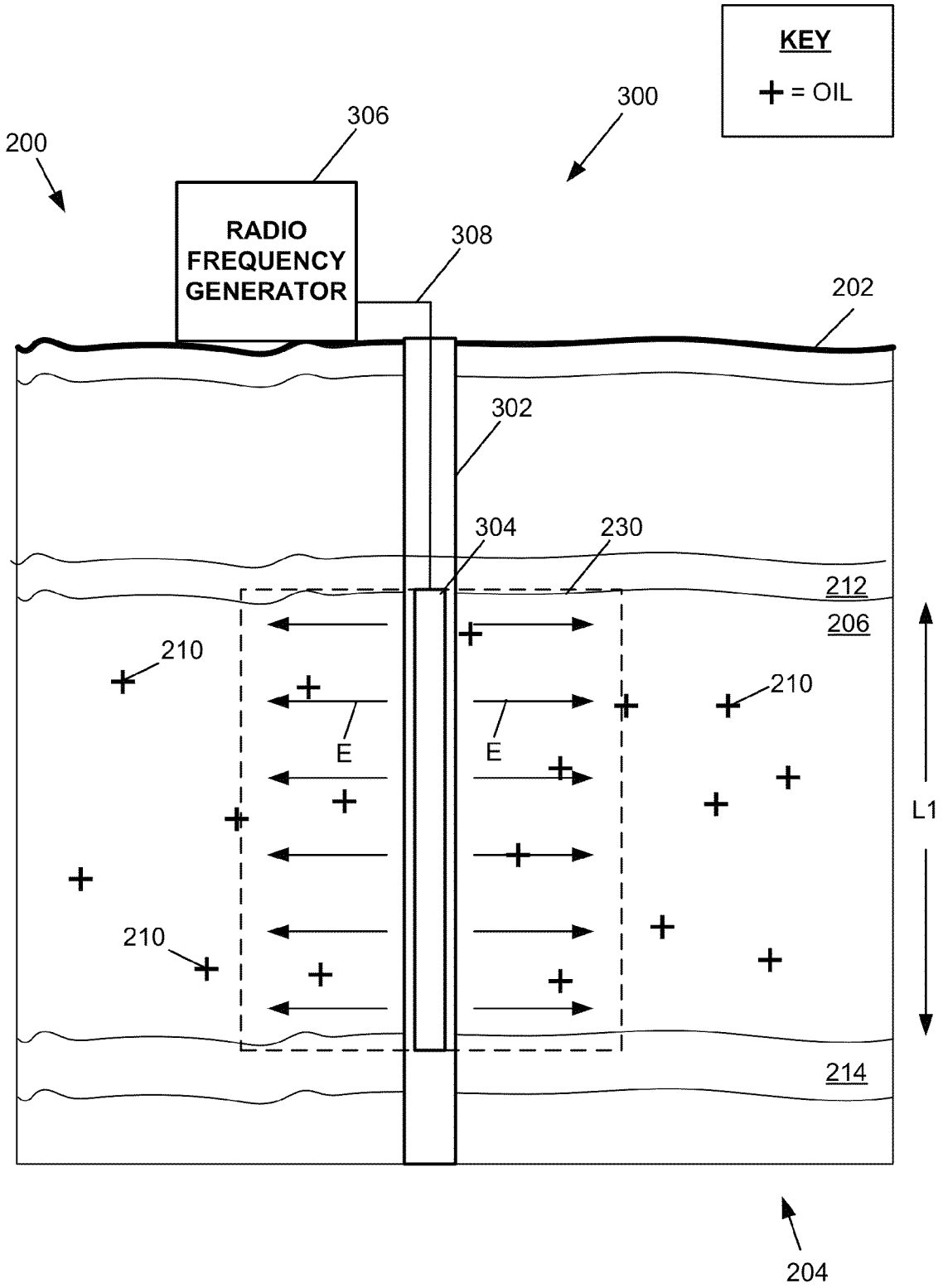
FIG. 3 is a cross-sectional view of the portion of the Earth shown in FIG. 2, and further illustrating an oil extraction system heating a first portion of the oil-bearing formation using radio frequency energy.

FIG. 3 is a schematic cross-sectional view of the portion 200 of the Earth and also illustrates part of an example oil extraction system 300. The portion 200 includes the surface 202, the oil-bearing formation 206 containing oil 210, the overburden 212, and the underburden 214. In this example, the part of the oil extraction system 300 includes a wellbore 302, an antenna 304, a radio frequency generator 306, and conductor 308. A first portion 230 of the oil bearing formation 206 is also shown. FIG. 3 also illustrates an example of the operation 102 (FIG. 1), of the method 100, during which the first portion 230 of the oil bearing formation 206 is heated using radio frequency energy.

The wellbore 302 is typically formed by drilling through the surface 202 and into the underground layers 204 including at least through the overburden 212, and typically into the oil-bearing formation 206. The wellbore 302 can be a vertical, horizontal, or slanted wellbore, or combinations thereof. In some embodiments, the wellbore includes an outer cement layer surrounding an inner casing. In some embodiments the casing is formed of fiberglass or other RF transparent material. An interior space is provided inside of the casing of the wellbore 302, which permits the passage of parts of the oil extraction system 300 as well as fluids and steam, as discussed herein. In some embodiments, the interior space of the wellbore 302 has a cross-sectional distance in a range from about 5 inches to about 36 inches. Additionally, apertures are formed through the casing and cement to permit the flow of fluid and steam between the oil-bearing formation 206 and the interior space of the wellbore 302.

In this example, an oil extraction process is initiated by inserting an antenna 304 into the wellbore 302 and heating the oil 210 within a first portion 230 of the oil-bearing formation 206 using radio frequency energy.

The antenna 304 is a device that converts electric energy into electromagnetic energy, which radiates from the antenna 304 in the form of electromagnetic waves E. An example of the antenna 304 is illustrated and described in more detail with reference to FIG. 4. In some embodiments the antenna has a length L1 approximately equal to a dimension of the oil-bearing formation 206, such as the vertical depth of the formation 206. For a horizontal wellbore 302, the length L1 can be selected to be equal to a horizontal dimension of the oil-bearing formation 206. Longer or shorter lengths can also be used, as desired. In some embodiments, a length L1 of the antenna 304 is in a range from about 30 meters to about 3000 meters. Other embodiments have multiple antennas 304 of other sizes.

The antenna 304 is inserted into the wellbore 302 and lowered into position, such as using a rig (not shown) at the surface 202. Rigs are typically designed to handle pieces having a certain maximum length, such as 40 foot lengths to 120 foot lengths. Accordingly, in some embodiments the antenna 304 is formed of two or more pieces having lengths equal to or less than the maximum length. In some embodiments ends of the antenna 304 pieces are threaded to permit the pieces to be screwed together for insertion into the wellbore 302. The antenna is then lowered down into the wellbore until it is positioned within the oil-bearing formation 206.

The radio frequency generator 306 operates to generate radio frequency electric signals that are delivered to the antenna 304. The radio frequency generator 306 is typically arranged at the surface in the vicinity of the wellbore 302. In some embodiments, the radio frequency generator 306 includes electronic components, such as a power supply, an electronic oscillator, a power amplifier, and an impedance matching circuit. In some embodiments, the radio frequency generator 306 is operable to generate electric signals having a frequency inversely proportional to a length L1 of the antenna to generate standing waves within the 304. For example, when the antenna 304 is a half-wave dipole antenna, the frequency is selected such that the wavelength of the electric signal is roughly twice the length L1. In some embodiments, the antenna has a length of about ⅗ of the wavelength. In some embodiments the radio frequency generator 306 generates an alternating current (AC) electric signal having a sine wave.

In some embodiments, the frequency of the electric signal generated by the radio frequency generator is in a range from about 5 kHz to about 20 MHz, or in a range from about 50 kHz to about 2 MHz.

In some embodiments, the radio frequency generator 306 generates an electric signal having a power in a range from about 50 kilowatts to about 2 Megawatts. In some embodiments, the power is selected to provide minimum amount of power per unit length of the antenna 304. In some embodiments, the minimum amount of power per unit length of antenna 304 is in a range from about 0.5 kW/m to 5 kW/m. Other embodiments generate more or less power.

The conductor 308 provides an electrical connection between the radio frequency generator 306 and the antenna 304, and delivers the radio frequency signals from the radio frequency generator 306 to the antenna 304. In some embodiments, the conductor 308 is contained within a conduit that supports the antenna in the appropriate position within the oil-bearing formation 206, and is also used for raising and lowering the antenna 304 into place. An example of a conduit is a pipe. One or more insulating materials are included inside of the conduit to separate the conductor 308 from the conduit. In some embodiments the conduit and the conductor 308 form a coaxial cable. In some embodiments the conduit is sufficiently strong to support the weight of the antenna 304, which can weigh as much as 5,000 pounds to 10,000 pounds in some embodiments.

Once the antenna 304 is properly positioned in the oil-bearing formation, the radio frequency generator 306 begins generating radio frequency signals that are delivered to the antenna 304 through the conductor 308. The radio frequency signals are converted into electromagnetic energy, which is emitted from the antenna 304 in the form of electromagnetic waves E. The electromagnetic waves E pass through the wellbore and into at least a first portion 230 of the oil-bearing formation. The electromagnetic waves E cause dielectric heating to occur, due to the molecular oscillation of polar molecules present in the first portion 230 of the oil-bearing formation 206 caused by the corresponding oscillations of the electric fields of the electromagnetic waves E. The radio frequency heating continues until a desired temperature has been achieved at the outer extents of the first portion 230 of the oil-bearing formation 206.

Figure 4:
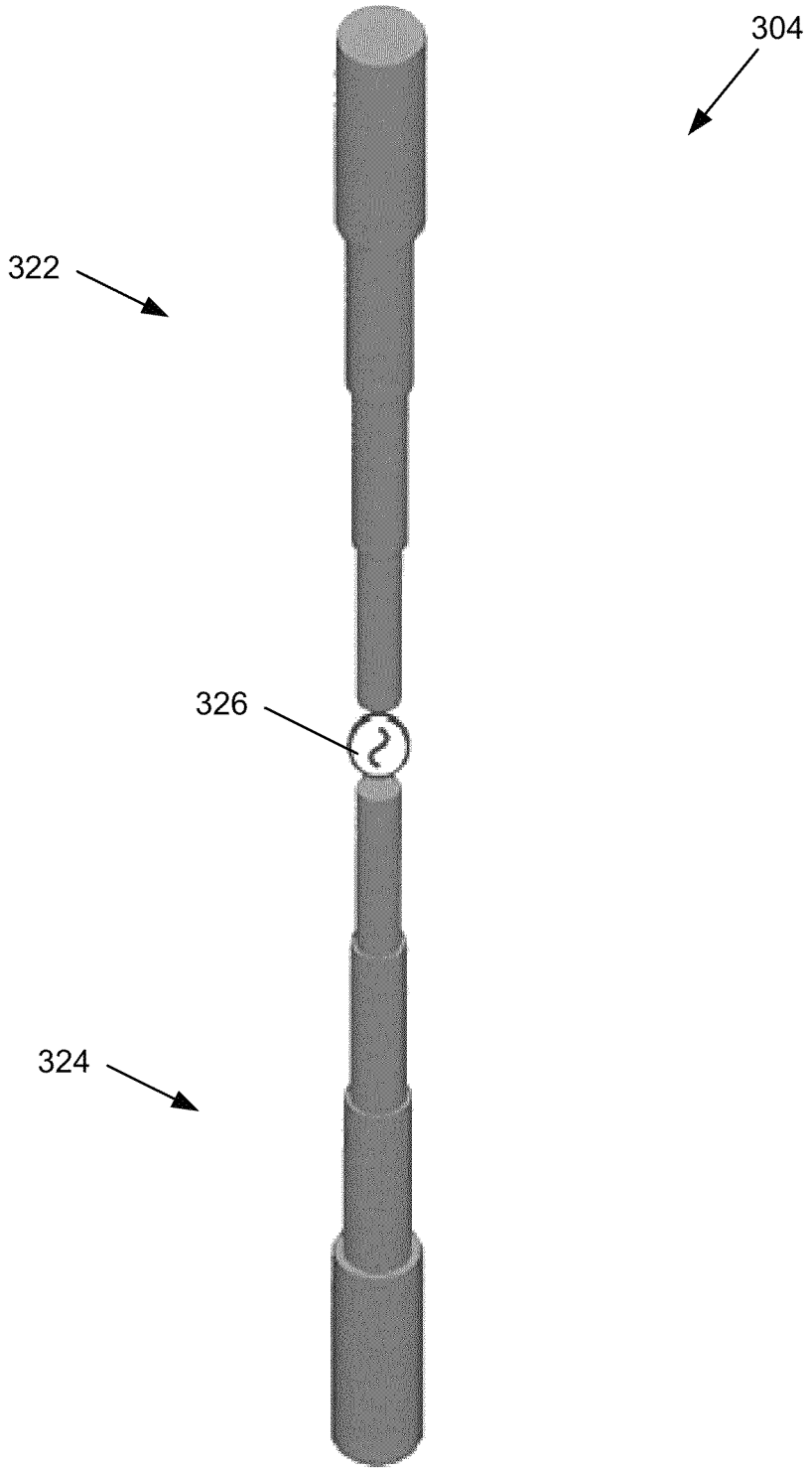
FIG. 4 is a schematic perspective diagram illustrating an example of an antenna of the oil extraction system shown in FIG. 3.

FIG. 4 is a schematic perspective diagram illustrating an example of the antenna 304. In this example, the antenna 304 includes antenna elements 322 and 324.

In some embodiments, the antenna 304 is a half-wave dipole antenna having antenna having axially aligned antenna elements 322 and 324 each having lengths of roughly one-quarter wavelength of the electric signal generated by the radio frequency generator 306 (FIG. 3). The antenna elements 322 and 324 are formed of electrically conductive material, such as a metal. An example of a suitable material is aluminum and/or copper. In some embodiments the antenna elements 322 and 324 are separated by a gap.

In some embodiments, the antenna elements 322 and 324 are electrically connected to the conductor 308 (FIG. 3) at a center 326.

Examples of suitable antennas 304 are described in co-pending and commonly assigned U.S. Ser. No. 13/838,783, titled SUBSURFACE ANTENNA FOR RADIO FREQUENCY HEATING, and filed on even date herewith, the disclosure of which is hereby incorporated by reference in its entirety. For example, some embodiments include an antenna 304 with antenna elements having a cylindrical shape (not shown). In other embodiments, the antenna 304 has a configuration in which the cross-sectional sizes of the antenna elements 322 and 324 increase in size from the center 326 to distal ends of the antenna elements 322 and 324. In some embodiments, this shaped configuration of the antenna 304 provides more even heat distribution within the first portion 230 of the oil-bearing formation 206 (FIG. 3).

Figure 5:
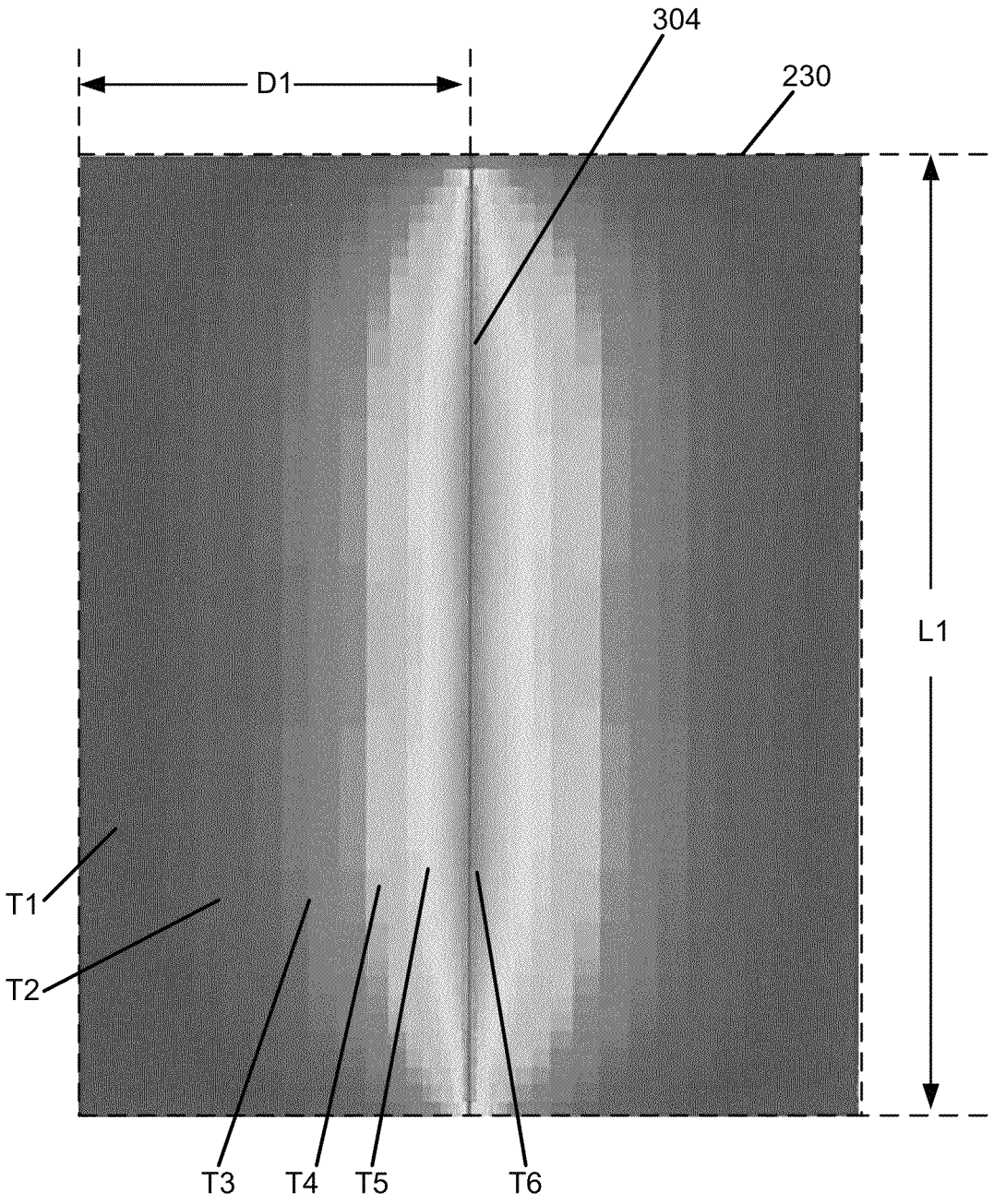
FIG. 5 is a diagram depicting a calculated temperature distribution of the first portion of the oil-bearing formation after heating with radio frequency energy.

FIG. 5 is a diagram depicting a calculated temperature distribution of the first portion 230 of the oil-bearing formation 206 after radio frequency heating. The antenna 304 is also shown.

The time required to heat the first portion 230 of the oil-bearing formation 206 depends on a number of factors, including the distance across the first portion 230 to be heated, the desired minimum temperature to be achieved within the first portion 230, the power generated by the radio frequency generator, the frequency of operation, the length of the antenna, the structure and composition of the wellbore, and the electrical characteristics (e.g., dielectric properties, such as dielectric constant and loss tangent) of the first portion 230.

The radio frequency heating operates to raise the temperature of the oil-bearing formation 206 from an initial temperature to at least a desired temperature greater than the initial temperature. In some formations, the initial temperature is about 120° F. In other formations, the initial temperature can range from as low as 40° F. to as high as 240° F. Radio frequency heating is performed until the temperature within the first portion 230 is raised to the desired minimum temperature to reduce the viscosity of the oil 210 sufficiently. In some embodiments, the desired minimum temperature is in a range from about 160° F. to about 200° F., or about 180° F. In some embodiments, the temperature of the first portion 230 is increased at least between about 40° F. and about 80° F., or about 60° F. Much higher temperatures can also be achieved in some embodiments, particularly in portions of the oil-bearing formation immediately adjacent to the antenna 304.

The diagram in FIG. 5 demonstrates the temperature distribution within different regions of the first portion 230 after heating for a period of time with the antenna 304. The most distal regions are the coolest (temperature T1), while the proximal regions are the warmest (temperature T2). In some embodiments, the temperature T1 is in a range from about 160° F. to about 200° F., or about 180° F. In some embodiments the temperature T6 reaches about 470° F. The temperatures T2, T3, T4, and T5 are between temperatures T1 and T6.

In some embodiments, the radial distance D1 between the antenna 304 and the outer periphery of the first portion 230 is in a range from about 10 feet to about 50 feet, or about 30 feet. To demonstrate the three-dimensional size of an example first portion 230, when the first portion 230 has a radial distance D1 of 30 feet and a height of 150 feet, the volume of the first portion 230 is 424,115 cubic feet of oil bearing formation. Radio frequency heating can be used to heat a first portion 230 having sizes greater than or less than these examples. A larger size can be obtained, for example, by increasing the length of the antenna 304 and providing additional power to the antenna, or by increasing the length of time of the radio frequency heating.

In some embodiments, the length of time that the radio frequency heating is applied is in a range from about 1 month to about 1 year, or in a range from about 4 months to about 8 months, or about 6 months. As discussed above, the time period can be adjusted by adjusting other factors, such as the power of the antenna, or the size of the first portion.

Figure 6:
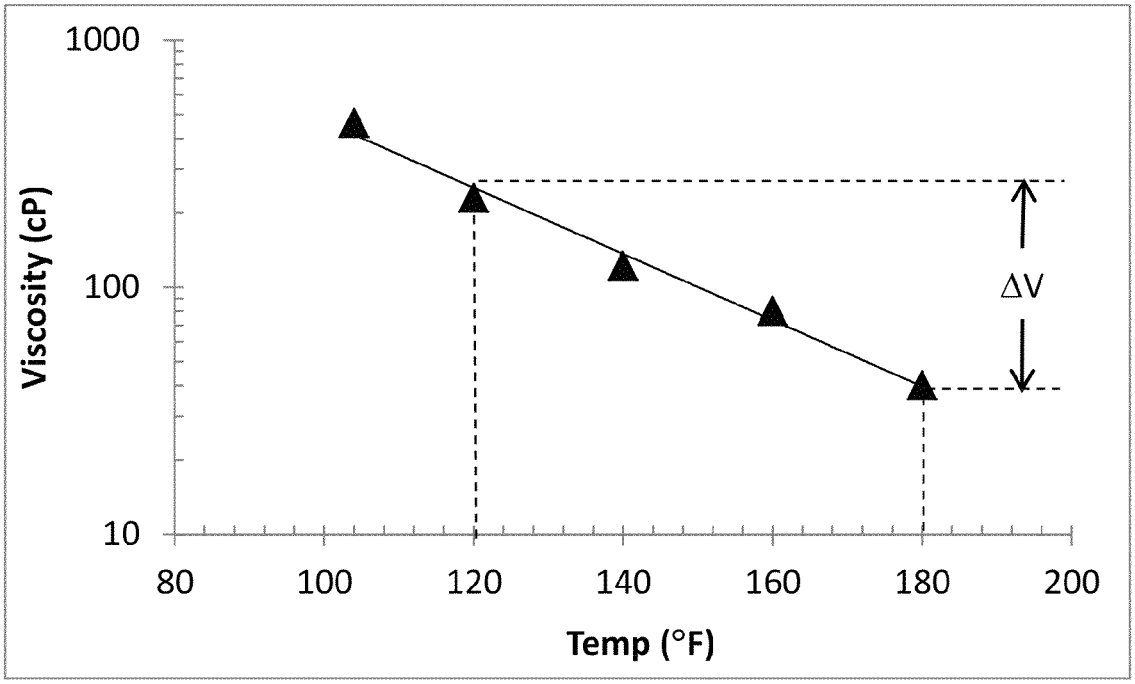
FIG. 6 is a diagram illustrating exemplary viscosities of a type of heavy oil across a range of temperatures.

FIG. 6 is a diagram illustrating exemplary viscosities of a type of heavy oil across a range of temperatures.

At lower temperatures, heavy oil has a relatively high viscosity, such as in a range from about 230 centipoises to about 290 centiposes at 120° F. When at this viscosity, the flow of oil within the oil-bearing formation 206 is very slow.

When the temperature of the first portion 230 (FIG. 3) is heated, such as to a temperature of 180° F., the viscosity of the oil goes down. For example, the viscosity of the oil at 180° F. is in a range from about 40 to about 50 centiposes.

The well flow rate depends on several variables such as bottomhole pressure, oil saturation, well diameter, pump capacity, etc. However, Darcy's laws establishes that, keeping all other variables constant (permeability, deltaP, etc.) the flow is inversely proportional to the fluid viscosity. Accordingly, the ratio of the viscosities at two different temperatures is directly proportional to the increase of the well flow rate.

As one example, average viscosity data measured across an oil-bearing formation containing a heavy oil had the viscosities shown in Table 1:

TABLE 1

| ° F. | 104 | 120 | 140 | 160 | 180 |
|---|---|---|---|---|---|
| Viscosity (cP) | 462 | 230 | 122 | 80 | 40 |

The change in temperature results in a change in viscosity ($\Delta V$) in a range from about 50 centipoises to about 900 centipoises or more. In the specific average data shown in FIG. 1, the heated oil is less than ⅓ as viscous as the oil at the initial temperature. When at this heated viscosity, the flow of oil within the oil-bearing formation is increased.

Figure 7:
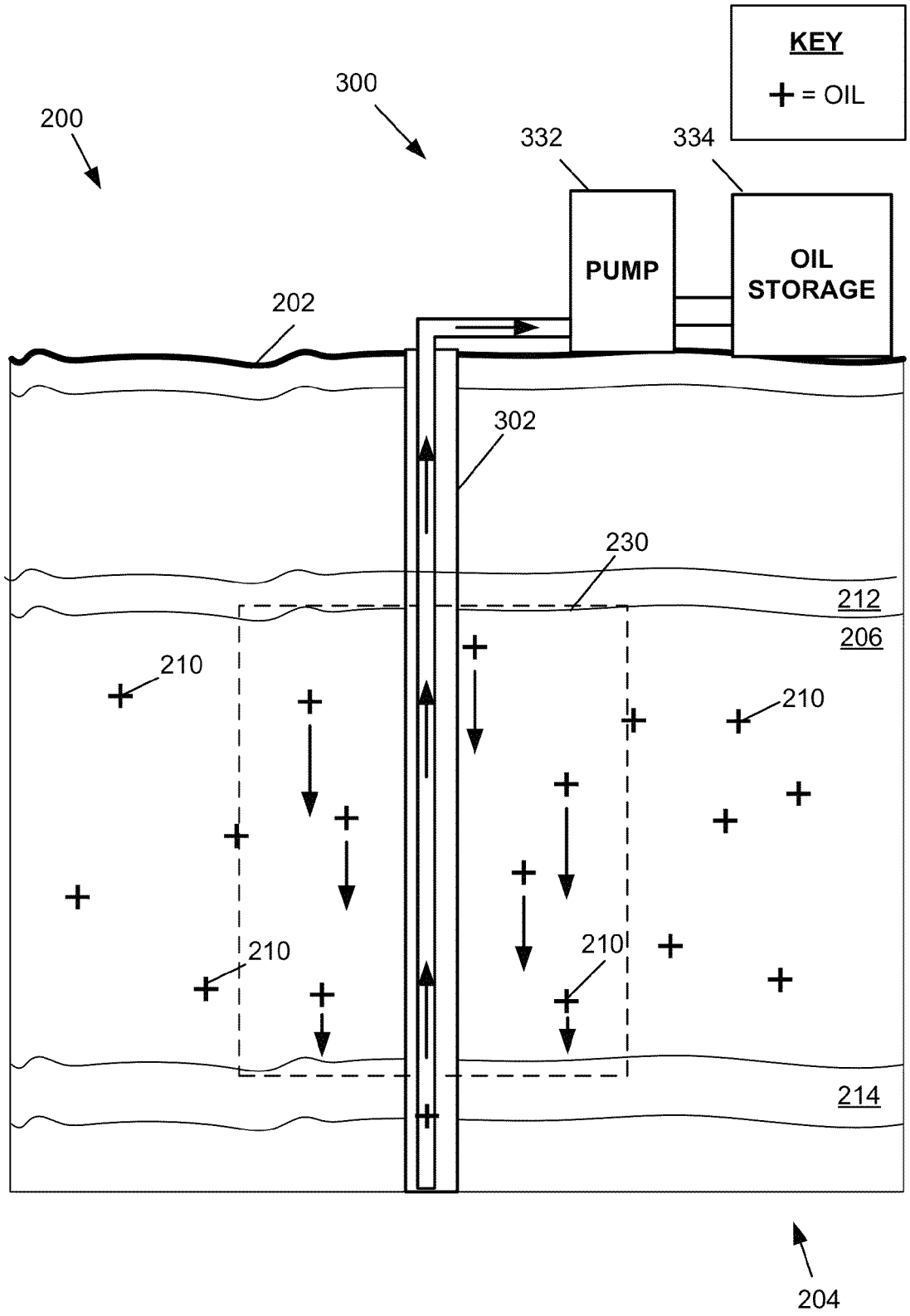
FIG. 7 is a schematic cross-sectional view of the portion of the Earth shown in FIG. 2, and further illustrating the oil extraction system of FIG. 3 extracting oil from the first portion of the formation.

FIG. 7 is a schematic cross-sectional view of the portion 200 of the Earth and also illustrates parts of the example oil extraction system 300. The portion 200 includes the surface 202, the oil-bearing formation 206 containing oil 210, the overburden 212, and the underburden 214. In this example, the parts of the oil extraction system 300 include the wellbore 302, a pump 332, and an oil storage 334. The first portion 230 of the oil bearing formation 206 is also shown. FIG. 7 also illustrates an example of the operation 104 (FIG. 1), of the method 100, during which oil 210 is extracted from the first portion 230 of the formation 206.

As the first portion 230 of the formation 206 is heated, the viscosity of the oil 210 is reduced, and the oil 210 begins to flow more quickly within the formation 206, and gravity tends to pull the oil 210 and other fluids downward. For example, once the viscosity of the oil 210 is reduced, the flow of other fluids, such as water (brine) and free and dissolved gases, which was previously inhibited by the viscous oil, may also be improved within the formation 206.

In some embodiments, after the periphery of the first portion 230 has been heated to the desired minimum temperature, the antenna 304 (FIG. 3) is removed from the wellbore 302, and a pump 332 begins operating to pump fluid, typically including the oil 210, from the first portion 230. In some embodiments the pump 332 is coupled directly to the wellbore 302, while in other embodiments a pump conduit is inserted into the wellbore 302. The pump 332 applies a suction inside of the wellbore 302, which draws the oil up the wellbore 302 and into the oil storage 334. In some embodiments multiple pumps are used. Additionally, some embodiments include one or more check valves to prevent backflow of the oil 210.

The pump 332 continues pumping (which can be operated continuously or periodically, as needed) until a suitable volume of the fluid, including oil 210, has been removed from the first portion 230.

Without utilizing an enhanced oil recovery process, the extraction of oil from an oil-bearing formation may be about 10 to 15 percent (primary production). Radio frequency heating can be used as described herein to increase the production from the heated portion of the oil-bearing formation, such as to a range from about 35 to about 45 percent, thus creating a void that will allow for increased steam injectivity.

In some formations 206 the oil 210 is intermixed with other fluids or materials. For example, the oil 210 can be intermixed with brine. Therefore, in some embodiments a separating device is used to separate the oil from the brine before or after storage in the oil storage 334.

Figure 8:
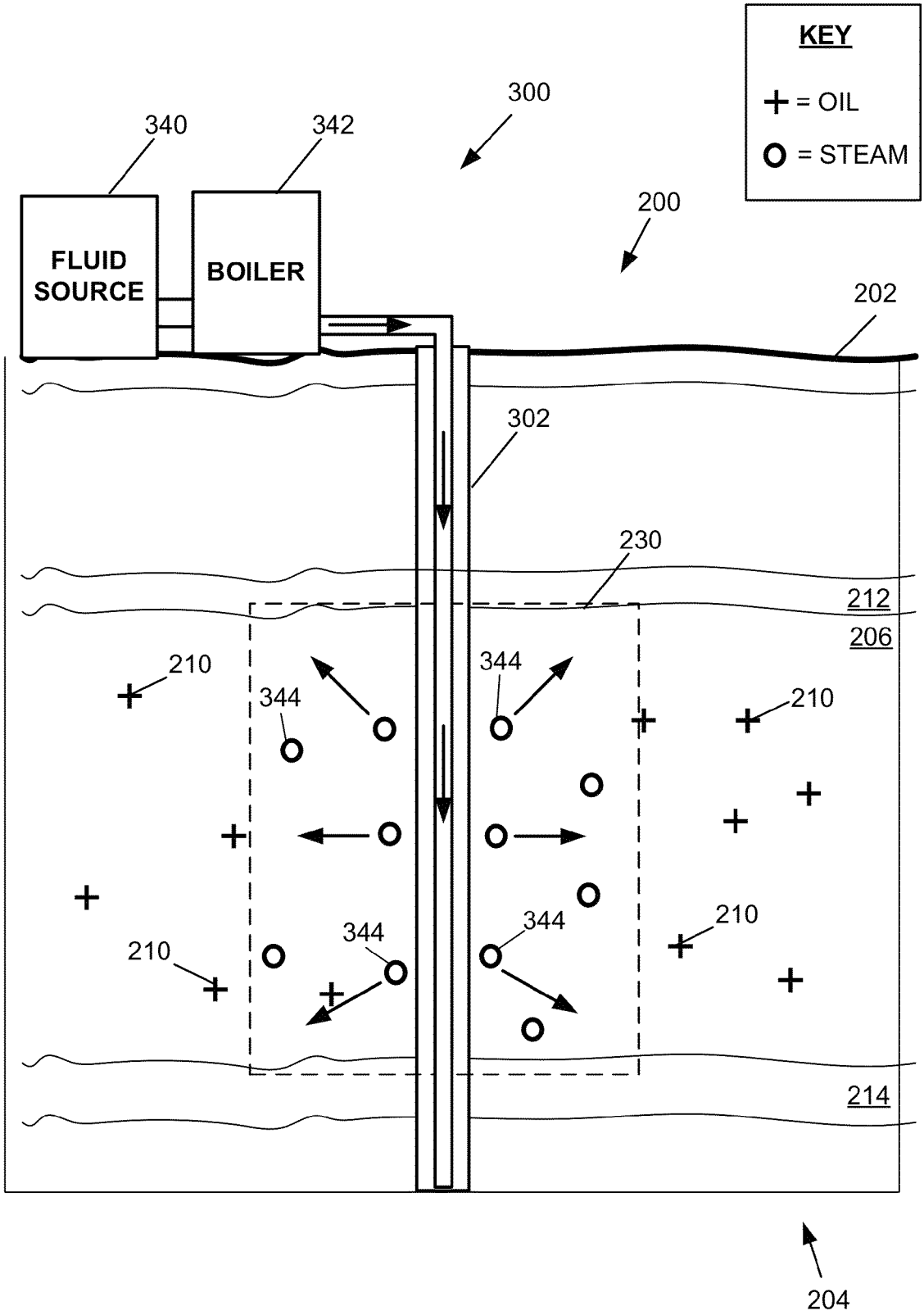
FIG. 8 is a schematic cross-sectional view of the portion of the Earth shown in FIG. 2, and further illustrating the oil extraction system of FIG. 3 injecting steam into the first portion of the formation.
Figure 9:
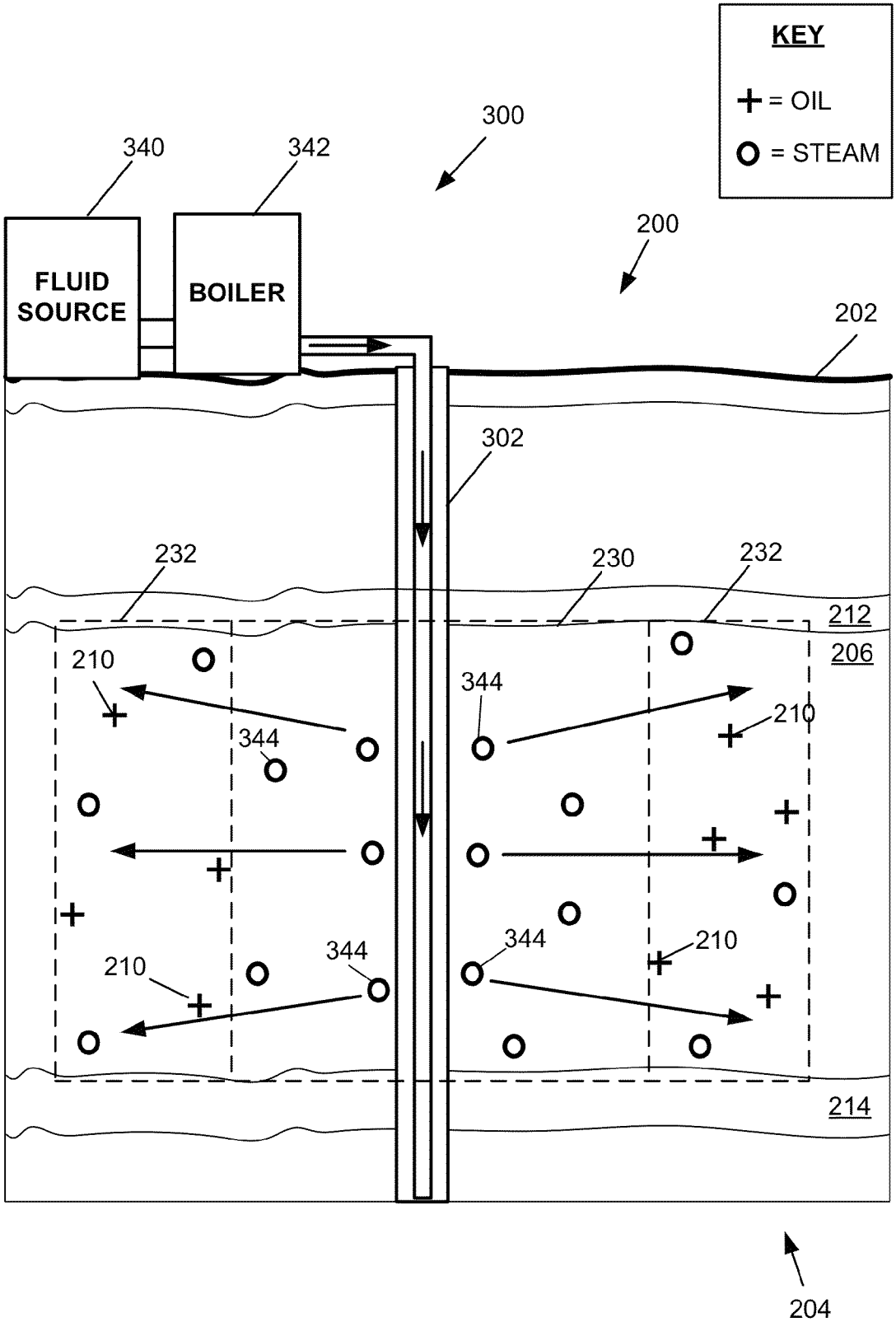
FIG. 9 is a schematic cross-sectional view of the portion of the Earth shown in FIG. 2, and further illustrating the oil extraction system of FIG. 3 injecting steam into a second portion of the formation.

FIGS. 8 and 9 are schematic cross-sectional views of the portion 200 of the Earth and also illustrate parts of the example oil extraction system 300. The portion 200 includes the surface 202, the oil-bearing formation 206 containing oil 210, the overburden 212, and the underburden 214. In this example, the parts of the oil extraction system 300 include the wellbore 302, a fluid source 340, and a boiler 342. The first portion 230 of the oil bearing formation 206 is also shown. FIGS. 7-8 also illustrate an example of the operation 106 (FIG. 1), of the method 100, during which steam 344 is injected into the first portion 230 of the oil bearing formation to heat an adjacent second portion 232 (FIG. 9) containing oil 210.

Once at least some of the oil 210 has been removed from the first portion 230, space previously occupied by the oil 210 is opened up, and the steam injectivity of the first portion 230 of the formation 206 is greatly improved.

Accordingly, the boiler 342 is used to heat a fluid, such as water, carbon dioxide, propane, butane, and naphtha, from the fluid source 340 to generate steam 344. The steam 344 is pumped into the wellbore 302 and pushed into the first portion 230 of the formation 206. The volume of steam that can be injected into the first portion 230 is similar to the volume of materials removed from the first portion 230.

In some embodiments, the steam 344 is heated to and injected into the first portion 230 at a temperature in a range from about 300° F. to about 600° F.

The steam 344 causes further heating of the oil-bearing formation, both within the first portion 230, and in surrounding regions.

FIG. 9 illustrates the continued heating of the surrounding regions, and more specifically the heating of the second portion 232 adjacent the first portion 230. Over time, the heat spreads further into the oil-bearing formation. The steam heating continues until the outer periphery of the second portion 232 has achieved a desired minimum temperature. In some embodiments, the injection of the steam 344 includes soaking periods, during which no additional steam 344 is injected, but the existing steam 344 within the first and second portions 230 and 232 is allowed to continue to soak into and warm the second portion 232. In some embodiments soaking periods and steaming periods are repeated until the second portion reaches the desired minimum temperature.

Figure 10:
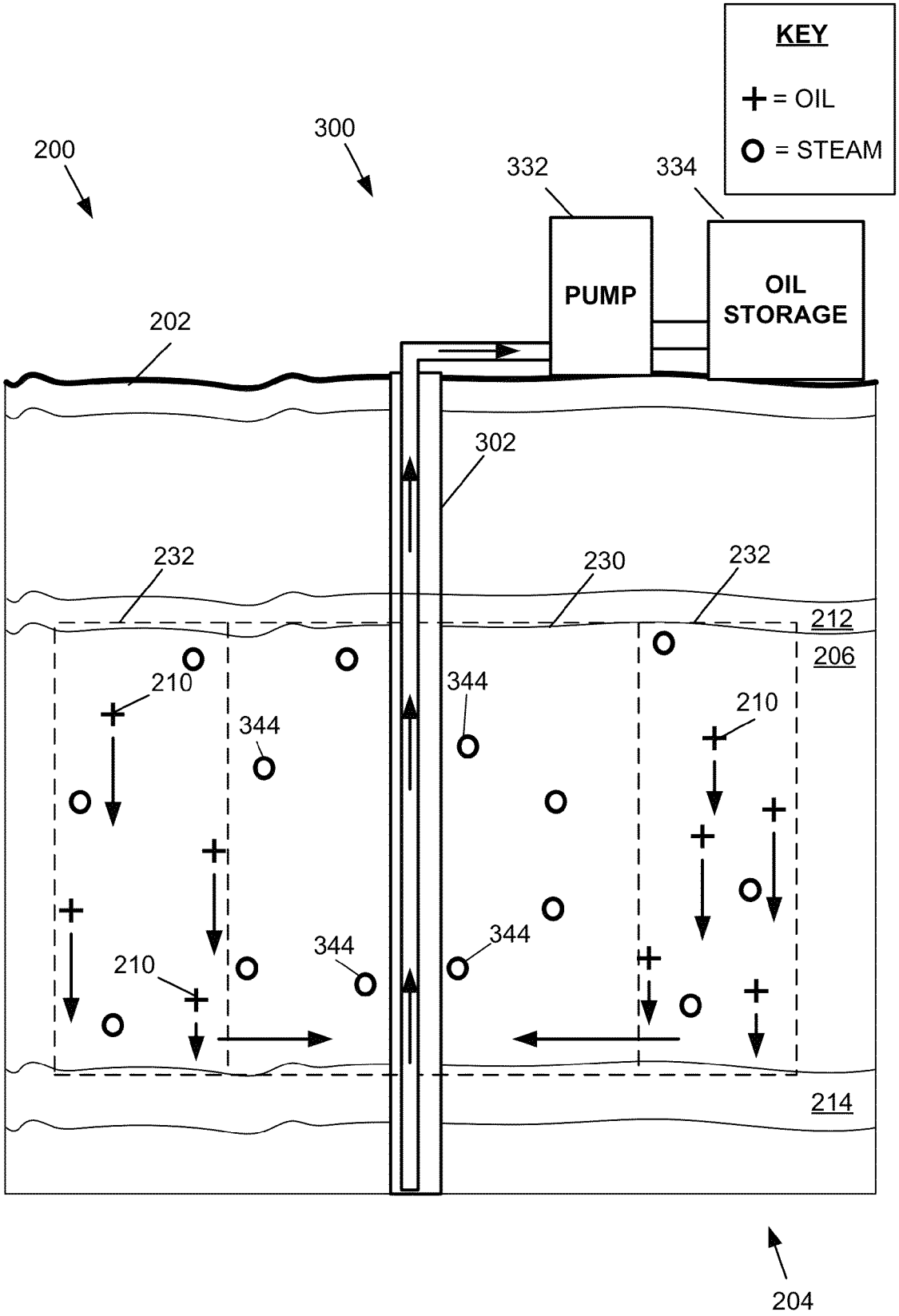
FIG. 10 is a schematic cross-sectional view of the portion of the Earth shown in FIG. 2, and further illustrating the oil extraction system of FIG. 3 extracting oil from the second portion of the formation.
Figure 11:
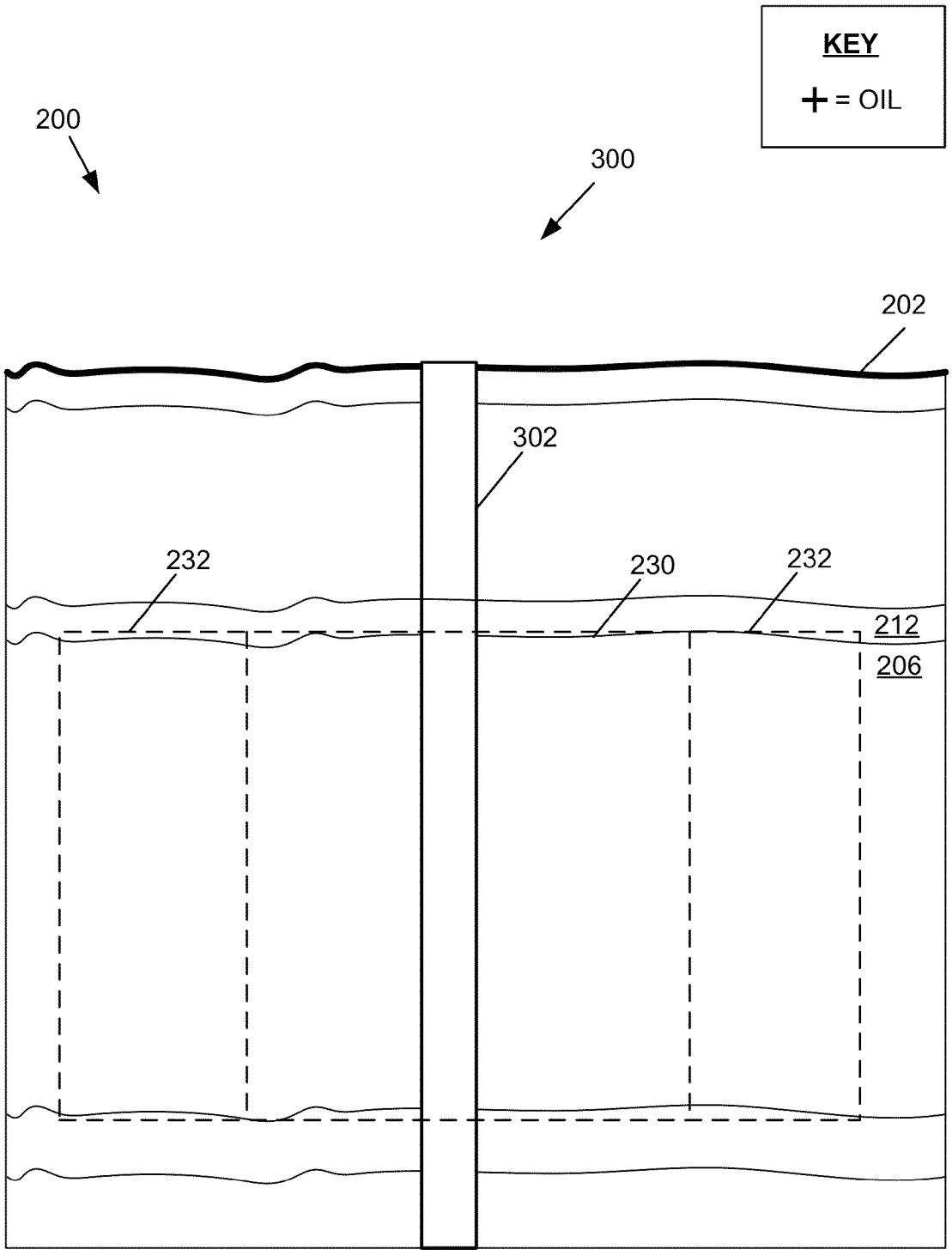
FIG. 11 is a schematic cross-sectional view of the portion of the Earth shown in FIG. 2 after having extracted the oil from the oil-bearing formation.

FIGS. 10-11 are schematic cross-sectional views of the portion 200 of the Earth and also illustrate parts of the example oil extraction system 300. The portion 200 includes the surface 202, the oil-bearing formation 206 containing oil 210, the overburden 212, and the underburden 214. In this example, the parts of the oil extraction system 300 include the wellbore 302, the pump 332, and the oil storage 334. The first portion 230 of the oil bearing formation 206 is also shown. FIGS. 10-11 also illustrate an example of the operation 108 (FIG. 1), of the method 100, during which oil 210 is extracted from the second portion 232 of the oil bearing formation 206.

As the steam 344 heats the oil 210, the viscosity of the oil 210 in the second portion 232 is reduced. As a result, the oil 210 begins to flow more quickly within the oil bearing formation 206. The oil 210 is pulled downward by gravity, and may also tend to flow into the vacant space previously occupied by oil 210 within the first portion.

The pump 332 is then operated to extract the oil from the second portion by drawing the oil up the wellbore 302 and into the oil storage 334.

FIG. 11 illustrates the oil bearing formation 206 after removal of the oil 210 (which is no longer present in FIG. 11).

Steam injection can then be repeated, if desired, to extract more oil from adjacent portions of the oil-bearing formation 206.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A method of extracting oil from an oil-bearing formation, the method comprising:

heating a first portion of the formation containing oil with radio frequency energy generated by a radio frequency generator electrically coupled to an antenna, the antenna being positioned within a wellbore and located within the first portion of the formation to heat the first portion to a minimum temperature of about 160° F., wherein the radio frequency generator delivers power in a range from about 50 kilowatts to about 2 Megawatts, and a power per unit length of antenna is in a range from about 0.5 kW/m to 5 kW/m;

extracting the oil from the first portion of the formation after heating the first portion of the formation containing oil with the radio frequency energy and prior to injecting steam into the first portion of the formation;

injecting steam into the first portion of the formation to heat a second portion of the formation containing oil adjacent to the first portion; and extracting the oil from the second portion of the formation, and wherein extracting the oil from the first portion creates a void, and wherein injecting steam into the first portion comprises injecting the steam into the void, and wherein extracting the oil from the first portion of the formation improves steam injectivity of the first portion.

2. The method of claim 1, further comprising allowing the steam to soak into the second portion of the formation for a period of time before extracting the oil from the second portion of the formation.

3. The method of claim 1, further comprising repeatedly injecting steam and extracting the oil from consecutive adjacent portions of the formation containing oil.

4. The method of claim 1, wherein the antenna is made of aluminum, copper, or combinations thereof.

5. The method of claim 1, wherein the first portion of the formation has a radial distance in a range from about 10 feet to about 50 feet.

6. The method of claim 5, wherein the first portion is heated by at least about 40° F.

7. The method of claim 1, wherein the first portion is heated to a minimum temperature in a range from about 160° F. to about 200° F.

8. The method of claim 1, wherein extracting the oil further comprises extracting additional fluids.

9. An oil extraction system comprising:

a radio frequency generator;

an antenna configured to be positioned within a wellbore and electrically coupled to the radio frequency generator to generate radio frequency energy and to heat a first portion of a formation containing oil adjacent the wellbore with the radio frequency energy generated by the radio frequency generator, wherein the antenna is located within a first portion of the formation to heat the first portion to a minimum temperature of about 160° F., wherein the radio frequency generator delivers power in a range from about 50 kilowatts to about 2 Megawatts, and a power per unit length of antenna is in a range from about 0.5 kW/m to 5 kW/m;

a pump configured to extract oil from the first portion of the formation after heating the first portion of the formation containing oil with the radio frequency energy; and a steam generator configured to inject steam into the first portion of the formation after the oil from the portion of the formation has been removed, and wherein extracting the oil from the first portion creates a void, and wherein injecting steam into the first portion comprises injecting the steam into the void, and wherein extracting the oil from the first portion of the formation improves steam injectivity of the first portion.

10. The oil extraction system of claim 9, wherein the radio frequency generator generates an alternating current sine wave signal.

11. The oil extraction system of claim 9, wherein the antenna is a dipole antenna.

12. The oil extraction system of claim 9, wherein the antenna is a half-wavelength dipole antenna.

13. The oil extraction system of claim 9, wherein the radio frequency energy generated by the radio frequency generator has a frequency in a range from about 5 kHz to about 20 MHz.

14. The oil extraction system of claim 9, wherein the radio frequency energy generated by the radio frequency generator has a frequency in a range from about 50 kHz to about 2 MHz.

15. The oil extraction system of claim 9, wherein the antenna has a length in a range from about 30 meters to about 3000 meters.

16. The oil extraction system of claim 9, further comprising the wellbore, wherein the wellbore is a horizontal wellbore.

17. The oil extraction system of claim 9, wherein the pump is further configured to extract oil from a second portion of the formation after the injected steam heats the second portion of the formation containing oil adjacent to the first portion.

18. The oil extraction system of claim 9, wherein the first portion of the formation has a radial distance in a range from about 10 feet to about 50 feet.

19. The oil extraction system of claim 9, wherein the first portion is heated to a minimum temperature in a range from about 160° F. to about 200° F.

20. The oil extraction system of claim 9, wherein the first portion is heated by at least about 40° F.

* * * * *